US010851808B2

(12) United States Patent
Bachmaier et al.

(10) Patent No.: US 10,851,808 B2
(45) Date of Patent: Dec. 1, 2020

(54) PIEZOHYDRAULIC ACTUATOR

(71) Applicant: Siemens Aktiengesellschaft, Munich (DE)

(72) Inventors: Georg Bachmaier, Munich (DE); Christian Bachmann, Munich (DE); Wolfgang Zöls, München-Lochhausen (DE); Iason Vittorias, Munich (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/485,233

(22) PCT Filed: Feb. 5, 2018

(86) PCT No.: PCT/EP2018/052752
§ 371 (c)(1),
(2) Date: Aug. 12, 2019

(87) PCT Pub. No.: WO2018/146035
PCT Pub. Date: Aug. 16, 2018

(65) Prior Publication Data

US 2019/0368515 A1 Dec. 5, 2019

(30) Foreign Application Priority Data

Feb. 10, 2017 (DE) ..... 10 2017 202 131

(51) Int. Cl.
*F15B 11/04* (2006.01)
*F15B 7/08* (2006.01)
(Continued)

(52) U.S. Cl.
CPC ..... *F15B 11/0413* (2013.01); *F15B 7/08* (2013.01); *F15B 9/09* (2013.01); *F15B 11/036* (2013.01);
(Continued)

(58) Field of Classification Search
CPC ..... F14B 11/0413; F14B 11/036; F14B 9/09; F14B 2211/7107; F14B 2211/775
See application file for complete search history.

(56) References Cited

U.S. PATENT DOCUMENTS 3,741,458 A 6/1973 Aylesworth ..... 226/145
4,531,451 A 7/1985 Mouton et al. ..... 92/108
(Continued)

FOREIGN PATENT DOCUMENTS

CN 106133370 A 11/1916 ..... F16D 25/12
CN 1276894 A 12/2000 ..... A63G 31/02
(Continued)

OTHER PUBLICATIONS

Zoels et al., "A novel piezohydraulic actuator as artificial muscle in robotic applications," 2015 IEEE/RSJ International Conference on Intelligent Robots and Systems (IROS), Congress Center Hamburg, Sep. 28-Oct. 2, 2015, Hamburg, Germany, pp. 4712-4717, 2015.
(Continued)

*Primary Examiner* — Thomas E Lazo
*Assistant Examiner* — Daniel S Collins
(74) *Attorney, Agent, or Firm* — Slayden Grubert Beard PLLC

(57) ABSTRACT

An actuator comprising: a piezo actuator; a drive having a drive chamber and a drive piston element driven by the piezo actuator; a first output having an output chamber and a piston element; and a second output having an output chamber and a piston element. At least part of the hydraulic fluid is conveyed out of the drive chamber by movement of the drive piston element and into the first output chamber. At least part of the hydraulic fluid is conveyed out of the drive chamber and into the second output chamber. The second output piston element has a hydraulically active second output face which is different in size from the first output
(Continued)

face. There may be a coupling device mechanically coupling the first output piston element to the second output piston element.

13 Claims, 1 Drawing Sheet

(51) Int. Cl.
*F15B 9/09* (2006.01)
*F15B 11/036* (2006.01)

(52) U.S. Cl.
CPC ..... *F15B 2211/30505* (2013.01); *F15B 2211/7107* (2013.01); *F15B 2211/775* (2013.01)

(56) References Cited

U.S. PATENT DOCUMENTS

| | | | | |
|---|---|---|---|---|
| 6,468,082 | B1 | 10/2002 | Denne | 434/55 |
| 10,072,677 | B2 * | 9/2018 | Bachmaier | H02N 2/043 |
| 2016/0281747 | A1 * | 9/2016 | Bachmaier | F15B 7/003 |
| 2016/0354962 | A1 | 12/2016 | Hung | 60/571 |
| 2017/0227023 | A1 | 8/2017 | Bachmaier et al. | |
| 2017/0356472 | A1 * | 12/2017 | Ballard | H01R 43/048 |
| 2019/0271336 | A1 | 9/2019 | Zöls et al. | |

FOREIGN PATENT DOCUMENTS

| | | | | |
|---|---|---|---|---|
| CN | 203779788 | U | 8/2014 | B29C 45/26 |
| WO | 2011/035828 | A1 | 3/2011 | B30B 15/16 |
| WO | 2014/001083 | A1 | 1/2014 | F04B 17/00 |
| WO | 2014/146804 | A1 | 9/2014 | F15B 7/00 |
| WO | 2016/015879 | A1 | 2/2016 | F15B 13/02 |
| WO | 2017/198420 | A1 | 11/2017 | F15B 11/02 |
| WO | 2018/146035 | A1 | 8/2018 | F15B 11/036 |

OTHER PUBLICATIONS

German Office Action, Application No. 10 2017 202 131.4, 8 pages, dated Dec. 1, 2017.
International Search Report and Written Opinion, Application No. PCT/EP2018/052752, 23 pages, dated Apr. 18, 2018.
Chinese Office Action, Application No. 201880020673.X, 6 pages, dated Jun. 11, 2020.

* cited by examiner

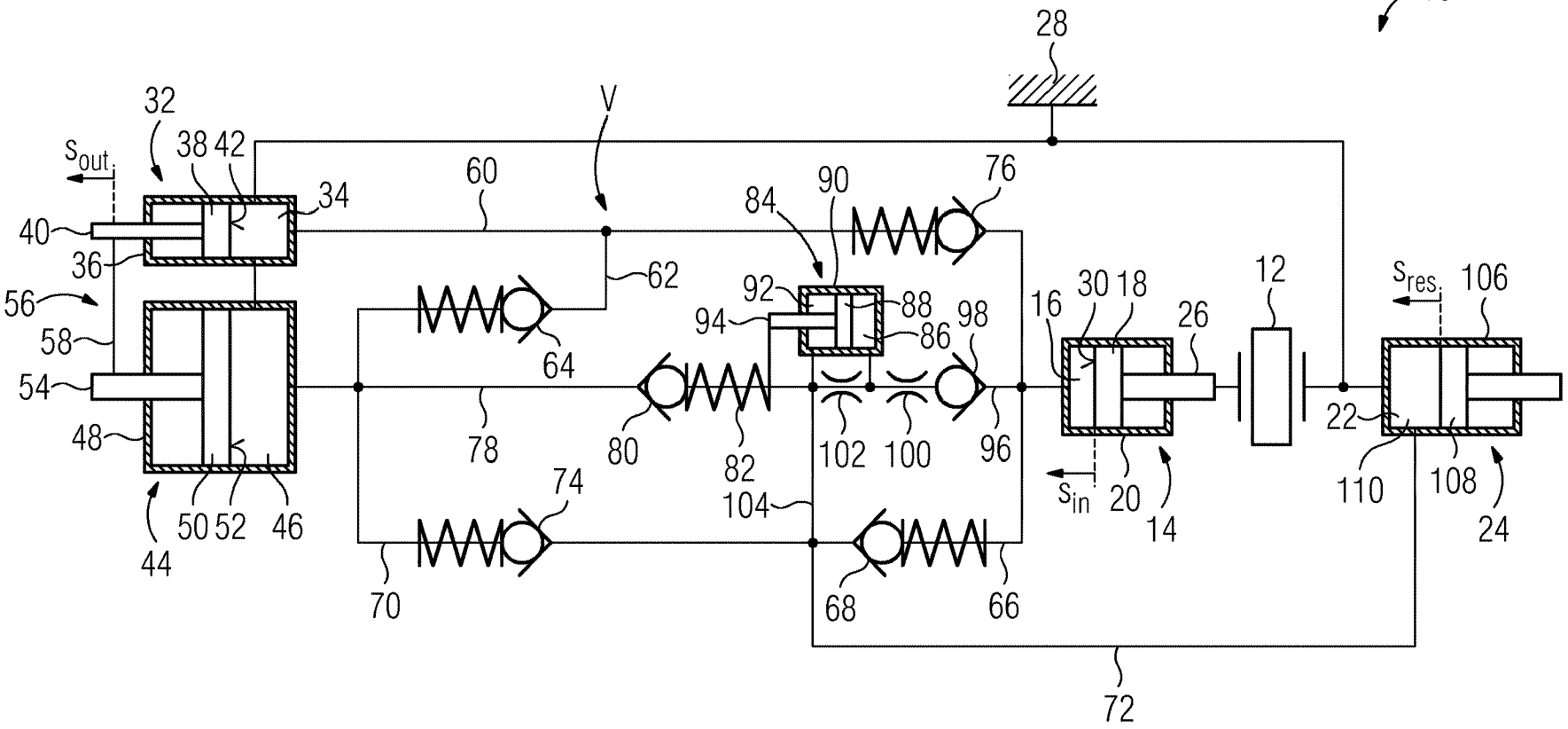
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
V
$S_{res.}$
$S_{in}$
$S_{out.}$

PIEZOHYDRAULIC ACTUATOR

CROSS-REFERENCE TO RELATED APPLICATIONS

This application is a U.S. National Stage Application of International Application No. PCT/EP2018/052752 filed Feb. 5, 2018, which designates the United States of America, and claims priority to DE Application No. 10 2017 202 131.4 filed Feb. 10, 2016, the contents of which are hereby incorporated by reference in their entirety.

TECHNICAL FIELD

The present disclosure relates to actuators. Various embodiments may include piezohydraulic actuators and/or methods for operating a piezohydraulic actuator.

BACKGROUND

Actuators which are usually also called final control elements are usually used to convert signals, in particular electric signals, into a mechanical movement and/or at least one other physical variable, in order for it to be possible as a result, for example, for at least one process to be influenced actively by means of the respective actuator. For example, actuators are used in vehicles, in order to move respective actuating elements, such as flaps or valves, for example, by means of the actuators. Furthermore, an actuator can be used, for example, in order to eject at least one tool of a machine tool.

Here, in particular, four properties of an actuator are of particular importance: force, deflection, speed and installation space. In the case of a multiplicity of actuator applications, different operating points exist, at which either a high force or a high speed of the actuator is desirable or required. In the case of the abovementioned actuator for ejecting a tool in the case of a machine tool, there is firstly the requirement, for example, that the actuator or at least one output element of the actuator covers a path at a high speed from a starting position as far as contact with the tool to be ejected, particularly high forces not being required. Here, the tool is ejected by means of the output element.

As soon as the actuator or the output element is in contact with the tool to be ejected, there is the requirement, in contrast to the abovementioned requirement, that high forces should be provided by the actuator or by the output element, in order for it to be possible for the tool to be expelled and therefore ejected. A high speed is not required here, however, since a travel which is required for the actual ejection or a deflection of the actuator, in particular of the output element, which deflection is required for the ejection, is only very small. This results in at least two different, desirable or required modes for the actuator: a first one of the modes is a speed mode, in which, for example, the output element is moved rapidly and with a force which is merely low, as far as into contact with the tool. The second mode is a force mode, in which, although the output element is moved with a high force, it is moved over a travel which is merely small or it is moved slowly, in order, for example, to finally eject the tool. An actuator application of this type with the described modes is also used increasingly in robotics.

Here, for example, objects of different firmness are gripped by a robot, to which end at least one actuator is used. The robot is used, for example, to assist at least one person in his/her task along a production line. It is desirable here that the robot can as far as possible grip and, in particular, move both fragile or delicate objects and firm and possibly heavy objects. This requires a high flexibility in the form of an adaptable impedance of the actuator which is, for example, a constituent part of a gripping system or actuator system of the robot. By means of the gripping system or actuator system, the robot can accordingly grip objects and, in particular, move them around in three-dimensional space. Here, the same gripping system should have both the possibility to be a relatively soft system, in order, for example, to perform delicate tasks, and the possibility to behave like a system with high rigidity, in order for it to be possible as a result, for example, for high forces to be provided, by means of which even rigid and/or heavy and large objects can be gripped and possibly moved.

SUMMARY

The teachings of the present disclosure describe actuators and methods, by means of which the abovementioned modes can be realized.

Said object is achieved by way of a piezohydraulic actuator having the features of patent claim 1, and a method for operating a piezohydraulic actuator of this type having the features of patent claim 14. Advantageous refinements with expedient developments of the invention are indicated in the remaining claims.

BRIEF DESCRIPTION OF THE DRAWINGS

Further advantages, features, and details of the teachings herein are described in the following description of an exemplary embodiment on the basis of the drawing. The features and combinations of features which are mentioned in the preceding text in the description and the features and combinations of features which are mentioned in the following text in the description of the figures and/or are shown in the figures alone can be used not only in the respectively specified combination, but rather also in other combinations or on their own, without departing from the scope of the disclosure.

The single FIGURE of the drawing shows a diagrammatic illustration of a hydraulic circuit diagram of a piezohydraulic actuator incorporating teachings of the present disclosure.

DETAILED DESCRIPTION

Some embodiments include a piezohydraulic actuator, having at least one piezo actuator and having at least one drive which has a drive chamber which can be supplied with a hydraulic fluid and a drive piston element which delimits the drive chamber partially, can be driven by the piezo actuator and can be moved as a result. By means of the drive piston element, at least part of the hydraulic fluid can be conveyed out of the drive chamber by way of driving of the drive piston element. In other words, the drive piston element is driven by means of the piezo actuator and is moved as a result; thus, at least part of the hydraulic fluid which is first of all received in the drive chamber is conveyed out of the drive chamber by means of the drive piston element.

In some embodiments, the piezohydraulic actuator comprises at least one first output which has a first output chamber and a first output piston element which delimits the first output chamber partially. At least part of the hydraulic fluid which is conveyed out of the drive chamber can be introduced into the first output chamber. The first output piston element has a hydraulically active first output face which can be loaded with the hydraulic fluid which is introduced into the first output chamber. The first output piston element can be driven by way of said loading of the first output face with the hydraulic fluid which is introduced into the first output chamber, and can therefore be moved, in particular translationally.

In some embodiments, the piezohydraulic actuator has at least one second output which has a second output chamber and a second output piston element which delimits the second output chamber partially. At least part of the hydraulic fluid which is conveyed out of the drive chamber can be introduced into the second output chamber. In some embodiments, the second output piston element has a hydraulically active second output face which can be loaded with the hydraulic fluid which is introduced into the second output chamber. Here, the output faces are of different size. In other words, the second output face is larger or smaller than the first output face. The second output piston element can be driven by way of loading of the second output face with the hydraulic fluid which is introduced into the second output chamber. In other words, if the hydraulic fluid is introduced into the first output chamber, the first output face is loaded with the hydraulic fluid which is introduced into the first output chamber, as a result of which the first output piston element is driven and is therefore moved, in particular translationally. If the hydraulic fluid is introduced into the second output chamber, the second output face is loaded with the hydraulic fluid which is introduced into the second output chamber, as a result of which the second output piston element is driven and is moved, in particular translationally. It is preferably provided here that the output chambers and/or the output piston elements are arranged or connected fluidically in parallel with one another.

In some embodiments, the piezohydraulic actuator has a coupling device, by means of which the output piston elements are coupled mechanically to one another. This means that the output piston elements are not coupled to one another, for instance, pneumatically or electrically or hydraulically via the coupling device, but rather the output piston elements are coupled to one another mechanically via the coupling device, the coupling device being coupled or connected mechanically, for example, both to the first output piston element and to the second output piston element.

As a result of said mechanical coupling of the output piston elements, they move, for example, at the same time or synchronously. If, for example, the first output piston element is therefore driven in the described way and is moved, in particular translationally, the second output piston element is also moved with the first output piston element by virtue of the fact that the second output piston element is coupled or connected mechanically to the first output piston element via the coupling device. If, for example, conversely the second output piston element is driven in the described way and is moved, in particular translationally, the first output piston element is also moved with the second output piston element by virtue of the fact that the first output piston element is coupled or connected mechanically to the second output piston element via the coupling device. In other words, the first output piston element moves the second output piston element via the coupling device, or the second output piston element moves the first output piston element via the coupling device.

At least two modes of the piezohydraulic actuator which are different from one another can be realized by means of a piezohydraulic actuator incorporating teachings of the present disclosure. A first one of the modes is, for example, a speed mode, in which the first output piston element can be moved particularly rapidly or at a high first speed, but with a merely low first force, in particular when the second output face is larger than the first output face. The second mode is a force mode, in which, for example, the second output piston element can be moved at a second speed which is lower than the first speed, but with a second force which is higher than the first force, in particular when the second output face is larger than the first output face. It is therefore possible, for example, to move at least one output element of the actuator in the speed mode by means of the first output piston element at a high first speed, but with a merely low first force. In the force mode, the output element can be moved, for example, by means of the second output piston element at a second speed which is lower than the first speed, but with a second force which is higher than the first force. Since the output piston elements are coupled mechanically to one another here, a switchover can be carried out, in particular gently or in a jolt-free manner and/or autonomously or automatically, from one of the modes into the respective other mode and vice versa.

If, for example, the piezohydraulic actuator according to the invention is therefore used in a machine tool, in order to eject a tool by means of the piezohydraulic actuator, by, for example, the tool being ejected by means of the abovementioned output element, by the output element being driven by means of the piezohydraulic actuator, the output element can be moved, for example, starting from a starting position, by means of the first output piston element in the speed mode at a particularly high first speed and with a low first force, until the output element comes into at least indirect, in particular direct, contact with the tool to be ejected. From the contact of the output element with the tool to be ejected, the output element can then be moved further, for example, by means of the second output piston element in the force mode at a second speed which is lower than the first speed and with a second force which is higher than the first force, in order finally to eject the tool by means of the output element.

Furthermore, a piezohydraulic actuator incorporating teachings of the present disclosure can be used in a robot, in particular in a gripping system of the robot, in order for it to be possible for both delicate or fragile objects, in particular in the speed mode, and more stable and heavier objects in contrast, in particular in the force mode, to be gripped securely and firmly by means of the gripping system. Delicate or fragile objects are gripped and moved, for example, with the aid of the first output piston element and therefore with a merely low force, it being possible, for example, for heavy and/or stable objects to be gripped and moved by means of the second output piston element and therefore with a great force. Therefore, a conflict of objectives between the realization of a rapid, but low-force movement and the realization of a slow, but very powerful movement can be resolved by means of the piezohydraulic actuator in a way which is simple and favorable in terms of weight and installation space.

In some embodiments, the piezohydraulic actuator has a first supply line which is connected fluidically to the drive chamber and to the first output chamber and via which at least the part of the hydraulic fluid which is conveyed out of the drive chamber can be introduced into the first output chamber. Moreover, the piezohydraulic actuator has a second supply line which is connected fluidically to the first supply line and to the second output chamber and via which at least the part of the hydraulic fluid which is conveyed out of the drive chamber can be introduced into the second output chamber. Furthermore, the piezohydraulic actuator has at least one first check valve which is arranged in the second supply line, opens in the direction of the second output chamber and closes in the direction of the first supply line. This is to be understood to mean that the first check valve opens when the hydraulic fluid flows through the second supply line in the direction of or into the second output chamber. The first check valve prevents an undesired flow of the hydraulic fluid through the second supply line in the direction of or into the first supply line, however.

If, for example, the first output piston element or the movement of the first output piston element is counteracted by a correspondingly great counterforce, with the result that, for example, a pressure of the hydraulic fluid which is brought about by means of the piezo actuator or by means of the drive piston element is not sufficient to drive the first output piston element counter to the counterforce and therefore to move it, or with the result that the first output piston element can be moved only slightly, the pressure of the hydraulic fluid rises, for example, in particular until, for example, the first check valve releases the second supply line, with the result that the hydraulic fluid can flow through the second supply line into the second output chamber. The second output piston element is then driven or moved. In this way, a switchover can be carried out between said modes in a particularly simple and, in particular, autonomous or automatic manner, and a switchover can be carried out here, in particular, from the speed mode to the force mode.

Said counterforce acts, for example, on the first output piston element and therefore counteracts the first output piston element or its movement when the output element which can be configured, for example, in one piece with the respective output piston element or can be coupled, in particular mechanically, to the respective output piston element comes into contact or is in contact with the tool to be ejected. Therefore, the output element can be moved into contact with the tool by means of the speed mode in a rapid and low-force manner, and can then be moved further in a slow and powerful manner by means of the force mode.

In some embodiments, the piezohydraulic actuator has at least one third supply line which is connected fluidically to the drive chamber and via which the hydraulic fluid can be introduced out of a reservoir into the drive chamber. The reservoir is, for example, a constituent part of the piezohydraulic actuator. Furthermore, the piezohydraulic actuator has a second check valve which is arranged in the third supply line, opens in the direction of the drive chamber and closes in the direction of the reservoir. As a result, for example, the hydraulic fluid can flow through the third supply line into the drive chamber, an undesired flow of the hydraulic fluid out of the drive chamber through the third supply line into the reservoir being avoided by means of the second check valve.

If the piezo actuator is actuated, at least one piezo element of the piezo actuator, for example, in particular a piezo stack which comprises a plurality of piezo elements, expands, as a result of which, for example, a reduction in the volume of the drive chamber is brought about. As a result, at least part of the hydraulic fluid is conveyed out of the drive chamber. If the actuation or energization of the actuator is ended, the piezo actuator or the piezo element or the piezo stack contracts, for example, which is associated with an increase in the volume of the drive chamber. In order to avoid an excessive and/or undesired negative pressure in the drive chamber, which negative pressure results from the increase in the volume of the drive chamber, hydraulic fluid can additionally flow out of the reservoir via the third supply line and the second check valve and, in particular, can flow into the drive chamber in the case of the increase in the volume of the drive chamber.

In the case of the hydraulic fluid being conveyed out of the drive chamber, the second check valve prevents the hydraulic fluid from flowing in an undesired manner via the third supply line back into the reservoir. As a result, an appropriate flow of the hydraulic fluid can be ensured in a manner which is particularly simple and is therefore favorable in terms of weight and costs. By way of a corresponding movement to and fro of the drive piston element, hydraulic fluid can therefore be sucked successively via the third supply line out of the reservoir into the drive chamber, and hydraulic fluid can be conveyed out of the drive chamber to the respective output piston element, in order for it to be possible as a result for an appropriate movement of the respective output piston element and therefore of said output element to be realized.

In some embodiments, the piezohydraulic actuator has at least one fourth supply line which is connected fluidically to the second output chamber and via which hydraulic fluid can be introduced into the second output chamber out of a reservoir, in particular out of the abovementioned reservoir, bypassing the first supply line and the second supply line. This means that the fourth supply line bypasses the first supply line and the second supply line, and the hydraulic fluid which flows through the fourth supply line bypasses the first supply line and the second supply line and therefore does not flow through the first supply line or through the second supply line. Hydraulic fluid can therefore be fed out of the reservoir to the second output chamber independently of the first supply line and independently of the second supply line.

In some embodiments, the piezohydraulic actuator has, furthermore, a third check valve which is arranged in the fourth supply line, opens in the direction of the second output chamber and closes in the direction of the reservoir. If, for example, the abovementioned counterforce does not counteract the first output piston element or only a very low counterforce counteracts the first output piston element, with the result that the hydraulic fluid cannot flow through the second supply line and accordingly cannot flow via the second supply line into the second output chamber, since, for example, the first check valve which is arranged in the second supply line does not yet open or is still closed and therefore prevents a flow of the hydraulic fluid through the second supply line to the or into the second output chamber, the second output piston element is moved via the coupling device by means of the first output piston element or is moved together with the first output piston element, without it being possible for hydraulic fluid to flow via the second supply line into the second output chamber. By virtue of the fact that the second output piston element is also moved with the first output piston element, however, an increase in the volume of the second output chamber is brought about. In order to avoid the production of an undesired and/or excessive negative pressure in the second output chamber in a particularly simple way here, hydraulic fluid can then flow or be sucked into the second output chamber, not, for instance, via the first supply line or the second supply line, but rather via the fourth supply line and the third check valve.

In some embodiments, the second supply line is connected fluidically to the first supply line at a connecting point, a fourth check valve being arranged in the first supply line upstream of the connecting point, which fourth check valve opens in the direction of the connecting point and closes in the direction of the drive chamber. In other words in relation to a flow direction of the hydraulic fluid which flows from the drive chamber to the first output chamber through the first supply line, the fourth check valve is arranged upstream of the connecting point, the fourth check valve permitting a flow of the hydraulic fluid from the drive chamber through the first supply line in the direction of or into the first output chamber, since the fourth check valve opens correspondingly. An undesired flow of the hydraulic fluid from the connecting point and therefore, for example, from the first output chamber into the drive chamber can be avoided, however, by means of the fourth check valve. As a result, an appropriate flow of the hydraulic fluid can be ensured in a simple and inexpensive way.

In some embodiments, the piezohydraulic actuator has at least one discharge line which is connected fluidically to at least one of the output chambers and via which at least part of the hydraulic fluid can be discharged out of the at least one output chamber and can be conducted to a reservoir, in particular to the abovementioned reservoir. As an alternative or in addition, the discharge line is connected fluidically to the first supply line and/or to the second supply line and/or to the third supply line, with the result that, for example, at least part of the hydraulic fluid can be discharged out of the first supply line and/or out of the second supply line and/or out of the third supply line and can be conducted to said reservoir.

In some embodiments, the piezohydraulic actuator has a fifth check valve which is arranged in the discharge line, opens in the direction of the reservoir and closes in the direction of the at least one output chamber or in the direction of the respective supply line, to which the discharge line is possibly connected fluidically. If, for example, a counterforce acts on at least one of the output pistons, which counterforce is such that a reduction in the volume of the respective output chamber is brought about by means of the counterforce, at least part of the hydraulic fluid which is initially received in the respective output chamber can be discharged via the discharge line out of the respective output chamber, without damage of the piezohydraulic actuator occurring. If the abovementioned counterforce which counteracts the respective output piston element or its movement is so great that a movement of the respective output piston element cannot be brought about by means of the piezo actuator or by means of a pressure of the hydraulic fluid, which pressure can be brought about by way of the piezo actuator, which movement is such that an increase in the volume of the respective output chamber occurs, hydraulic fluid, for example, can be discharged out of the respective supply line via the discharge line and, in particular, can be conducted to or into the reservoir, without damage of the piezohydraulic actuator occurring. As a result, damage of the piezohydraulic actuator can be avoided in a simple and inexpensive way.

In some embodiments, it is possible for an opening force which opens the fifth check valve to be set. The opening force corresponds with an opening pressure of the hydraulic fluid. If a flow of the hydraulic fluid which is such that the flow of the hydraulic fluid in the discharge line is directed in the direction of the reservoir is brought about, for example, by means of the drive piston element and/or by means of at least one of the output piston elements, the fifth check valve opens when the hydraulic fluid in the discharge line reaches or exceeds the opening pressure. Since it is possible for the opening force to be set, the opening pressure, from which the fifth check valve releases the flow of the hydraulic fluid through the discharge line in the direction of the reservoir, can be set as appropriate.

In some embodiments, the fifth check valve has a spring element, the prestress of which can be set, in order to set the opening force as a result. As a result, the opening force can be set in a particularly appropriate manner and in a particularly simple and inexpensive way.

In some embodiments, the spring element of the fifth check valve is assigned a setting element which has at least one setting chamber. At least part of the hydraulic fluid which is conveyed out of the drive chamber can be introduced into the setting chamber. Furthermore, the setting element has a setting piston element which delimits the setting chamber partially and can be moved by means of the hydraulic fluid which is introduced into the setting chamber, by way of which the prestress of the spring element can be set. For example, the setting piston element is coupled or can be coupled at least indirectly to the spring element, with the result that the spring element can be stressed or relieved by way of movement of the setting piston element. As a result, the prestress of the spring element can be set in a particularly simple way in a manner which is appropriate and, in particular, autonomous or automatic.

In some embodiments, the piezohydraulic actuator has at least one setting line which is connected fluidically to the setting chamber and to the drive chamber and via which at least the part of the hydraulic fluid can be introduced into the setting chamber.

In some embodiments, a sixth check valve is arranged in the setting line, which sixth check valve opens in the direction of the setting chamber and closes in the direction of the drive chamber. As a result, for example, the sixth check valve permits a flow of the hydraulic fluid out of the drive chamber through the setting line in the direction of or into the setting chamber. Furthermore, an undesired flow of the hydraulic fluid out of the setting chamber through the setting line into the drive chamber can be avoided in a simple way by means of the sixth check valve.

In some embodiments, for the prestress of the spring element and therefore the opening pressure or the opening force to be set in a simple way in a particularly appropriate manner, at least one throttle which can be flowed through by the hydraulic fluid is arranged in the setting line, via which throttle at least the part of the hydraulic fluid can be introduced into the setting chamber.

In some embodiments, a second throttle is provided which can be flowed through by the hydraulic fluid, which second throttle is arranged fluidically in series with the first throttle and fluidically in parallel with the setting piston element. A first part of the flow flows into the setting chamber and therefore not through the second throttle, and, in parallel or at the same time, a second part of the flow flows through the second throttle and thus not into the setting chamber in the case of a flow (brought about by means of the piezo actuator and the drive piston element) of the hydraulic fluid out of the drive chamber through the setting line and through the first throttle.

Some embodiments include a method for operating a piezohydraulic actuator, in particular a piezohydraulic actuator as described above. Here, the piezohydraulic actuator comprises at least one piezo actuator, and at least one drive which has a drive chamber which can be supplied with a hydraulic fluid and a drive piston element which delimits the drive chamber partially, can be driven by the piezo actuator and can be moved as a result, in particular translationally, and by means of which at least part of the hydraulic fluid can be conveyed or is conveyed out of the drive chamber by way of driving of the drive piston element.

In some embodiments, the piezohydraulic actuator has at least one first output which has a first output chamber, into which at least part of the hydraulic fluid which is conveyed out of the drive chamber can be introduced, and a first output piston element which delimits the first output chamber partially, has a hydraulically active first output face which can be loaded with the hydraulic fluid which is introduced into the first output chamber, and can be driven by way of loading of the first output face with the hydraulic fluid which is introduced into the first output chamber, and can be moved as a result, in particular translationally.

In some embodiments, the piezohydraulic actuator comprises at least one second output which has a second output chamber, into which at least part of the hydraulic fluid which is conveyed out of the drive chamber can be introduced, and a second output piston element which delimits the second output chamber partially, has a hydraulically active second output face which is larger or smaller than the first output face and can be loaded with the hydraulic fluid which is introduced into the second output chamber, and can be driven by way of loading of the second output face with the hydraulic fluid which is introduced into the second output chamber. Moreover, the piezohydraulic actuator comprises a coupling device, by means of which the output piston elements are coupled mechanically to one another.

In some embodiments, the piezo actuator is actuated by means of at least one electric signal, by way of which the drive piston element is driven by means of the piezo actuator. Advantages and advantageous refinements of the apparatus are to be considered to be advantages and advantageous refinements of the methods, and vice versa.

In some embodiments, the piezo actuator is actuated by means of pulse width modulation (PWM). Therefore, the electric signal is, for example, an electric voltage in PWM form.

The drive chamber, the respective output chamber and the setting chamber are also simply called chambers. The drive piston element and/or the respective output piston element and/or the setting piston element are/is, for example, a piston which is received such that it can be moved translationally in a housing which is also called a cylinder, with the result that, for example, the respective housing and the respective piston delimit the respective chamber in each case partially. The respective piston and the respective housing therefore form, for example, a hydraulic cylinder.

In some embodiments, the drive piston element and/or the respective output piston element and/or the setting piston element are/is a constituent part of a bellows. Here, the constituent part of the bellows is, for example, an end wall of the bellows, with the result that the drive piston element and/or the respective output piston element and/or the setting piston element are/is, for example, an (in particular, axial) end wall of a bellows. Here, the respective bellows has, for example, a shell or a side wall, the respective chamber being delimited in each case partially by way of the respective end wall and the respective shell of the respective bellows. Here, for example, the respective end wall is connected to the respective shell, in particular is configured in one piece with the respective shell.

For example, the respective end wall can be moved to and fro translationally with an increase and shortening of the length of the respective shell, as in the case of a spring or folding bellows, for example. Here, the shell has a corrugated and/or serrated or folded or creased course, for example, at least in one length region. For example, the shell is deformed elastically when the end wall is moved translationally in one direction. In some embodiments, if the end wall which forms, for example, a piston is moved to and fro translationally, the shell is at least partially rolled onto the piston and unrolled from the piston, as in the case of a spring bellows, for example, in particular an air spring bellows, or a rolling lobe. The shell is formed, for example, from a plastic or from a metallic material. In particular, the shell can be formed from an elastically deformable material, in particular from rubber. Furthermore, the shell can be flexible or flexurally slack, that is to say dimensionally unstable.

In some embodiments, the respective check valve is configured, for example, as a conventional check valve with a valve element which is configured, for example, as a ball, and a spring, against the spring force of which the valve element and therefore the check valve overall can open. Furthermore, it is conceivable that the check valve is configured as a check flap or as a simple check valve, in the case of which, for example, a strip or band which is formed, in particular, from metal is provided, which strip or band covers and, as a result, closes at least one throughflow opening for the hydraulic fluid in a shut-off position. If a pressure of the hydraulic fluid which acts on the strip reaches or exceeds a threshold value, the strip is deformed and, as a result, is moved into a release position, in which the strip releases the throughflow opening.

The single FIGURE shows a diagrammatic illustration of a hydraulic circuit diagram of a piezohydraulic actuator 10, by means of which, for example, (as will be described in more detail in the following text) a movement of at least one output element (not shown in the FIGURE) can be brought about. Said movement of the output element is also called a deflection.

In some embodiments, the piezohydraulic actuator 10 and the output element are used in a machine tool and are utilized to eject at least one tool of the machine tool. Here, for example, the output element is driven by means of the piezohydraulic actuator 10, in order to move and, in particular, to eject the tool by means of the output element. Furthermore, it is conceivable that the output element and the piezohydraulic actuator 10 are used in a gripping system of a robot, in order to grip components and to move them around in three-dimensional space by means of the gripping system and by means of the robot.

In some embodiments, the piezohydraulic actuator 10 has at least one piezo actuator 12 which comprises at least one piezo element. In particular, the piezo actuator 12 has a plurality of piezo elements which form a piezo stack. By way of the application of an electric voltage to the piezo element or to the piezo stack and therefore, for example, to the piezo actuator 12, a mechanical movement of the piezo element or the piezo stack can be brought about, as will be described in further detail in the following text. The electric voltage is applied to the piezo actuator 12 or to the piezo element or to the piezo stack, for example, within the context of an actuation of said piezo actuator 12.

In some embodiments, the piezohydraulic actuator 10 has a drive 14 which comprises a drive chamber 16 and a drive piston element in the form of a drive piston 18. Furthermore, the drive 14 comprises a drive cylinder 20, in which the drive piston 18 is received such that it can be moved translationally. The drive cylinder 20 and the drive piston 18 delimit the drive chamber 16 in each case partially. Hydraulic fluid 22 can be introduced from a reservoir into the drive chamber 16. Here, the reservoir 24 is a constituent part of the piezohydraulic actuator 10, it being possible for the hydraulic fluid 22 to be received and to be stored at least temporarily in the reservoir 24. In other words, the drive chamber 16 can be supplied with at least part of the hydraulic fluid 22 which is received in the reservoir 24. The drive piston 18 is connected to a drive piston rod 26 of the drive 14, with the result that the drive piston rod 26 can be moved together with the drive piston 18 translationally relative to the drive cylinder 20. Here, the drive piston rod 26 can be driven by the piezo actuator 12 and, as a result, can be moved translationally relative to the drive cylinder 20. Since the drive piston 18 is connected to the drive piston rod 26, in particular is configured in one piece with it, the drive piston 18 can be driven by the piezo actuator 12 via the drive piston rod 26 and, as a result, can be moved translationally relative to the drive cylinder 20.

The piezohydraulic actuator 10 comprises, for example, a housing (which can be seen only in details in the FIGURE and is shown in a particularly diagrammatic manner), in which, for example, the drive chamber 16, the drive cylinder 20 and the drive piston 18 are received. By way of driving of the drive piston 18, at least part of the hydraulic fluid which is initially received in the drive chamber 16 can be conveyed out of the drive chamber 16. If, for example, the drive piston 18 is moved by the piezo actuator 12 via the drive piston rod 26 in such a way that a reduction in the volume of the drive chamber 16 occurs, at least part of the hydraulic fluid which is initially received in the drive chamber 16 is conveyed out of the drive chamber 16 by means of the drive piston 18. Here, $s_{in}$ in the FIGURE denotes a travel or a path by which the drive piston 18 is moved by means of the piezo actuator 12 via the drive piston rod 26, in particular in order to bring about a reduction in the volume of the drive chamber 16.

In some embodiments, the drive piston 18 has a hydraulically active drive face 30, by means of which at least the abovementioned part of the hydraulic fluid which is initially received in the drive chamber 16 can be conveyed out of the drive chamber 16. The hydraulic fluid which is received in the drive chamber 16 is therefore in contact with the hydraulically active drive face 30, via which a first pressure, in particular a drive pressure, of the hydraulic fluid can therefore be brought about by means of the drive piston 18. The hydraulic fluid is, for example, an incompressible fluid and can be configured, in particular, as oil.

In some embodiments, the piezohydraulic actuator 10 has at least one first output 32 which has a first output chamber 34. At least part of the hydraulic fluid which is conveyed out of the drive chamber 16 can be introduced into the first output chamber 34. Here, the first output 32 comprises a first output cylinder 36 and a first output piston element in the form of a first output piston 38 which is received in the first output cylinder 36 such that it can be moved translationally. Here, the first output cylinder 36 and the first output piston 38 delimit the first output chamber 34 in each case partially. Moreover, the first output 32 comprises a first output piston rod 40 which is connected to the first output piston 38, in particular is configured in one piece with it. As a result, the first output piston rod 40 can be moved together with the first output piston 38 translationally relative to the first output cylinder 36. If, for example, the hydraulic fluid is introduced into the first output chamber 34, with the result that an increase in the volume of the first output chamber 34 occurs, the output piston rod 40, for example, is extended out of the output cylinder 36. Here, $s_{out}$ in the FIGURE denotes a travel or a path by which the first output piston 38 and, together with it, the first output piston rod 40 are moved translationally relative to the first output cylinder 36 as a consequence of said increase in the volume of the first output chamber 34.

Since, for example, the abovementioned output element is coupled at least indirectly to the first output piston rod 40, the output element is moved together with the first output piston rod 40, in particular translationally, in particular by the travel $s_{out}$.

In some embodiments, the first output piston 38 has a hydraulically active first output face 42 which can be loaded with the hydraulic fluid which is introduced into the first output chamber 34. The hydraulic fluid which is introduced into the first output chamber 34 therefore comes into contact with the first output face 42 and acts on the first output face 42, which, in combination with the abovementioned pressure of the hydraulic fluid, results in a first force which acts on the first output piston 38. By means of said first force, the first output piston 38 can be moved translationally relative to the first output cylinder 36, in order to bring about, in particular, an increase in the volume of the first output chamber 34 as a result and accordingly to extend the first output piston rod 40 out of the first output cylinder 36. The first output piston 38 can therefore be driven by way of loading of the first output face 42 with the hydraulic fluid which is introduced into the first output chamber 34 and can be moved translationally relative to the output cylinder 36 as a result.

In some embodiments, the piezohydraulic actuator 10 has at least one second output 44 which has a second output chamber 46. At least part of the hydraulic fluid which is conveyed out of the drive chamber 16 can be introduced into the second output chamber 46. Furthermore, the second output 44 comprises a second output cylinder 48 and a second output piston element in the form of a second output piston 50 which is received in the second output cylinder 48 such that it can be moved translationally. Here, the second output cylinder 48 and the second output piston 50 delimit the second output chamber 46 in each case partially. The second output piston 50 has a hydraulically active second output face 52 which can be loaded with the hydraulic fluid which is introduced into the second output chamber 46. Here, the output faces 42 and 52 are of different size. In the case of the exemplary embodiment which is illustrated in the FIGURE, the second output face 52 is greater than the first output face 42.

In some embodiments, the second output 44 has a second output piston rod 54 which is connected to the second output piston 50, in particular is configured in one piece with it. The second output piston rod 54 can therefore be moved together with the second output piston 50 translationally relative to the second output cylinder 48. By way of loading of the second output face 52 with the hydraulic fluid which is introduced into the second output chamber 46, the second output piston 50 can be driven and, as a result, can be moved translationally relative to the second output cylinder 48.

The second output face 52 and the pressure of the hydraulic fluid result in a second force which acts on the second output piston 50 and by means of which the second output piston 50 can be moved translationally relative to the second output cylinder 48, as a result of which, in particular, an increase in the volume of the second output chamber 46 can be brought about. Since the second output piston rod 54 can be moved translationally together with the second output piston 50, the second output piston rod 54 can be extended out of the second output cylinder 48 by way of the bringing about of an increase in the volume of the second output chamber 46. Here, for example, the abovementioned output element is coupled or connected at least indirectly to the second output piston rod 54, with the result that the output element can be driven and therefore can be moved, in particular translationally, by way of moving of the second output piston rod 54.

The hydraulic fluid can flow into the respective output chamber 34 or 46, for example, at the abovementioned first pressure which is configured as a drive pressure. Since the output faces 42 and 52 are configured with different sizes, the drive pressure and the first output face 42 result in the first force, and the drive pressure and the second output face 52 result in the abovementioned second force. Here, the second force is greater than the first force.

In some embodiments, the piezohydraulic actuator 10 comprises a coupling device 56 which, in the case of the exemplary embodiment which is illustrated in the FIGURE, has at least one mechanical coupling element 58. By means of the coupling element 58 and therefore by means of the coupling device 56, the drive pistons 38 and 50 are coupled mechanically to one another, in particular via the output piston rods 40 and 54, with the result that the output pistons 38 and 50 and therefore the output piston rods 40 and 54 move synchronously or simultaneously and in the process by the same travel $s_{out}$ For example, the output chambers 34 and 46, the output cylinders 36 and 48, and the output pistons 38 and 50 are received in the housing 28. The FIGURE shows parallel coupling of the output pistons 38 and 50. Furthermore, it goes without saying that serial coupling of the output pistons 38 and 50 is possible.

In some embodiments, the piezohydraulic actuator 10 has a first supply line 60 which is connected fluidically to the drive chamber 16 and to the first output chamber 34 and via which at least said part of the hydraulic fluid which is conveyed out of the drive chamber 16 can be introduced into the first output chamber 34.

In some embodiments, the piezohydraulic actuator 10 comprises a second supply line 62 which is connected fluidically to the first supply line 60 and to the second output chamber 46 and via which at least the part of the hydraulic fluid which is conveyed out of the drive chamber 16 can be introduced into the second output chamber 46, in particular via at least part of the first supply line 60. Here, a first check valve 64 is arranged in the second supply line 62, which first check valve 64 opens in the direction of the second output chamber 46 and closes in the direction of the first supply line 60.

In some embodiments, a third supply line 66 is provided which is connected fluidically to the drive chamber 16 and to the reservoir 24 and via which the hydraulic fluid 22 can be introduced out of the reservoir 24 into the drive chamber 16. Here, a second check valve 68 is arranged in the third supply line 66, which second check valve 68 opens in the direction of the drive chamber 16 and closes in the direction of the reservoir 24.

In some embodiments, the piezohydraulic actuator 10 comprises at least one fourth supply line 70 which is connected fluidically to the second output chamber 46 and to the reservoir 24 and via which the hydraulic fluid 22 can be introduced into the second output chamber 46 out of the reservoir 24, bypassing the supply lines 60 and 62. Here, for example, a line part 72 which is common to the supply lines 66 and 70 forms both part of the supply line 66 and part of the supply line 70. Therefore, for example, the hydraulic fluid 22 can flow out of the reservoir 24 first of all through the line part 72 and then to the output chamber 46 or to the drive chamber 16. A third check valve 74 is arranged in the fourth supply line 70, which third check valve 74 opens in the direction of the second output chamber 46 and closes in the direction of the reservoir 24.

The second supply line 62 is connected fluidically to the supply line 60 at a connecting point V. In the flow direction of the hydraulic fluid 22 which flows from the drive chamber 16 to the first output chamber 34 and in the process flows through the supply line 60, a fourth check valve 76 is arranged in the first supply line 60 upstream of the connecting point V and downstream of the drive chamber 16, the fourth check valve 76 opening in the direction of the connecting point V and closing in the direction of the drive chamber 16.

In some embodiments, the piezohydraulic actuator 10 comprises a discharge line 78 which is configured as a discharge branch and is connected, in particular via the line part 72, fluidically to the reservoir 24 and fluidically to the output chambers 34 and 46 or to the supply lines 60 and 62, with the result that the hydraulic fluid can be discharged via the discharge line 78 out of the respective output chamber 34 or 46 or out of the respective supply line 60 or 62 and can be conducted, and therefore can be returned, to the reservoir 24. Here, the line part 72 also forms part of the discharge line 78. A fifth check valve 80 is arranged in the discharge line 78, which fifth check valve 80 opens in the direction of the reservoir 24 and closes in the direction of the output chamber 34 or 46 or in the direction of the supply line 60 or 62.

In some embodiments, the piezohydraulic actuator 10 realizes at least two modes, that is to say operating modes, of the piezohydraulic actuator 10 which are different than one another in a way which is particularly simple and, in particular, favorable in terms of installation space, weight and costs. A first one of the modes is what is known as a speed mode, in which the output element can be driven and as a result can be moved at a high first speed, but with a low first force. Here, the output element is driven actively in the speed mode, in particular, by means of the first output 32.

The second mode is a force mode, in which the output element is driven and is therefore moved at a second speed which is lower than the first speed, but with a second force which is higher than the first force. Here, the output element is driven actively, in particular, via the second output 44 in the force mode. Here, a switchover between the modes, in particular from the speed mode and the force mode, can be carried out in a particularly simple way and, in particular, autonomously.

The respective output 32 or 44 is configured as a hydraulic cylinder, the hydraulic cylinders being constituent parts of a hydraulic system to which the piezo actuator 12 is coupled as drive element. Here, the piezo actuator 12 is used in order to move the respective output piston 38 or 50 and, as a consequence, the output element.

As can be seen particularly clearly from the FIGURE, the outputs 32 and 44, in particular the output pistons 38 and 50, are connected fluidically in parallel with one another. For example, the output cylinders 36 and 48 and the drive cylinder 20 are fixed on the housing 28 or are connected fixedly to the latter. The output cylinders 36 and 48 and the drive cylinder 20 are respective housings, in which the respective output pistons 38 and 50 and the drive piston 18 are received such that they can be moved translationally. The respective output face 42 or 52 is also called a hydraulic cross-sectional area, the drive face 30 also being called a hydraulic cross-sectional area. Here, the output face 42 is smaller than the output face 52. Moreover, the output face 42 is smaller than the drive face 30, the drive face 30 being smaller than the output face 52.

In order to actuate the piezo actuator 12, a voltage in PWM form (PWM=pulse width modulation) is applied to said piezo actuator 12 or to the piezo element or to the piezo stack. In other words, the piezo actuator 12 is actuated by means of at least one electric signal in the context of a method for operating the piezohydraulic actuator 10, by way of which the drive piston 18 is driven by means of the piezo actuator 12 and is therefore moved translationally relative to the drive cylinder 20. Here, the electric signal is a PWM signal in the form of an electric voltage, by means of which the piezo actuator 12 is actuated. As a result of said actuation of the piezo actuator 12, the piezo element or the piezo stack expands, as a result of which the drive piston 18 is moved in such a way that a reduction in the volume of the drive chamber 16 occurs. As a result, the hydraulic fluid which is received in the drive chamber 16 is compressed or the pressure of the hydraulic fluid rises on account of the quasi-incompressibility of the hydraulic fluid.

If, for example, no counterforce or merely a low counterforce counteracts the movement of the output piston 38 or the output element, the check valve 64 remains closed, and the check valve 76 opens, with the result that hydraulic fluid flows from the drive into the output chamber 34. By virtue of the fact that the output face 42 is smaller than the drive face 30, a transmission is carried out of the travel $s_{in}$ into the travel $s_{out}$ or of a speed, at which the drive piston 18 is moved, into a higher speed than this, at which the output piston 38 is moved. Then, for example, the electric voltage or the PWM signal, by way of which the piezo actuator 12 is or was actuated, is set to zero, as a result of which the pressure in the drive 14 is reduced.

This results, for example, in an increase in the volume of the drive chamber 16, as a result of which a negative pressure is produced at least temporarily in the drive chamber 16. As a result, the check valve 68 is opened, with the result that hydraulic fluid is sucked from the reservoir 24 into the drive 14 or into the drive chamber 16. The electric voltage for actuating the piezo actuator 12 can then be increased again, as a result of which the above-described cycle is repeated. By way of successive bringing about of a reduction in the volume and an increase in the volume of the drive chamber 16, hydraulic fluid is sucked out of the reservoir 24 into the drive chamber 16 and is conveyed from the latter into the output chamber 34. The output piston 38 is deflected as a result.

Since the output piston 38 is connected mechanically to the output piston 50 via the coupling element 58, the output piston 50 is deflected, that is to say is moved, by the same travel $s_{out}$ as the output piston 38. Since, however, no hydraulic fluid is pumped actively into the output chamber 46 via the supply lines 60 and 62, a negative pressure would be produced in the output chamber 46 if no corresponding countermeasures were taken. As a result, a resistance would be produced which would counteract the deflection of the output pistons 38 and 50. In order to avoid this, a fluidic connection is established between the output chamber 46 and the reservoir 24 by way of the supply line 70. As a result, hydraulic fluid can flow in the described way out of the reservoir 24 via the supply line 70 and the check valve 74 into the output chamber 46 when the output piston 50 is moved by means of the output piston 38 in such a way that an increase in the volume of the output chamber 46 occurs. Therefore, the check valve 74 opens when a negative pressure occurs in the second output 44 or in the second output chamber 46 as a result of the described pumping of the hydraulic fluid into the first output 32. This ensures in a passive way that the output 44 has no influence or merely a small influence on the deflection of the output piston 38.

If, for example, the output element comes into contact with an obstacle which is configured, for example, as a tool to be ejected of a machine tool, the abovementioned counterforce occurs which counteracts the deflection or movement of the output element and therefore of the output pistons 38 and 50. It is then desirable that the piezohydraulic actuator 10 builds up a force which is as high as possible, in order to further deflect the output element despite the counterforce. This is possible merely to a limited extent with the aid of the first output 32, however, since its output face 42 has been selected to be very small, in order to realize a high speed transmission and therefore to move the output element or the output pistons 38 and 50 at a high speed, that is to say as rapidly as possible. The smaller the output face 42, in particular in comparison with the drive face 30, the lower the first force which acts as output force in the case of a maximum pressure in the first output 32.

For this reason, the check valve 64 and the supply line 62 are installed between the outputs 32 and 44. If, for example, the pressure rises in the output 32 on account of the counterforce which counteracts the movement of the output element, the check valve 64 opens, as a result of which the hydraulic fluid is also pumped (in particular, in addition to the output 32) to and, in particular, into the output 44, in particular into the output chamber 46. Since the output face 52 is considerably larger than the output face 42 and than the drive face 30, the output force increases in comparison with the output 32 in the case of a constant pressure of the hydraulic fluid.

If, for example, the pressure of the hydraulic fluid which is received in the supply lines 60 and 62, in the output chambers 34 and 46 and in the discharge line 78 exceeds an opening pressure of the check valve 80, the check valve 80 opens. The opening pressure results in an opening force which acts on the check valve 80 and above which the check valve 80 opens. Here, it is possible for the opening force or the opening pressure, above which the fifth check valve 80 opens, to be set. To this end, the check valve 80 comprises a spring element 82, the prestress of which can be set, in order to set the opening force or the opening pressure as a result. Here, the spring element 82 is assigned a setting element 84 which has at least one setting chamber 86 and a setting piston element in the form of a setting piston 88. Furthermore, the setting element 84 has a setting cylinder 90, the setting piston 88 being received in the setting cylinder 90 such that it can be moved translationally. The setting piston 88 and the setting cylinder 90 delimit the setting chamber 86 in each case partially.

In some embodiments, the setting piston 88 and the setting cylinder 90 delimit a further setting chamber 92 of the setting element 84, which further setting chamber 92 lies opposite the setting chamber 86. Here, part of the hydraulic fluid can be introduced, for example, into the respective setting chamber 86 or 92, in order for it to be possible as a result for the setting piston 88 to be moved to and fro translationally relative to the setting cylinder 90. Here, for example, the setting cylinder 90 is arranged in the housing 28 and is fixed on the housing 28. In particular, at least part of the hydraulic fluid which is conveyed out of the drive chamber 16 can be introduced into the setting chamber 86, in order to set the prestress of the spring element 82 as a result.

The setting piston 88 is connected to a setting piston rod 94, with the result that the setting piston rod 94 can be moved together with the setting piston 88 relative to the setting cylinder 90. Here, the setting piston 88 is connected mechanically to the spring element 82 via the setting piston rod 94. Here, for example, at least one setting line 96 is provided which is connected fluidically to the setting chamber 86 and to the drive chamber 16 and via which at least the part of the hydraulic fluid can be introduced into the setting chamber 86.

If, for example, hydraulic fluid is introduced, in particular conveyed, into the setting chamber 86, in particular out of the drive chamber 16 and via the setting line 96, this results in an increase in the volume of the setting chamber 86 and a reduction in the volume of the setting chamber 92. As a consequence, the setting piston rod 94 is extended out of the setting chamber 92, as a result of which, for example, the spring element 82 is stressed, in particular compressed. As a result, for example, the prestress of the spring element 82 and therefore the opening force or the opening pressure are increased. In other words, a pressure acts on the setting piston 88 from the hydraulic fluid which is received in the setting chamber 86, by means of which pressure the setting piston 88 is moved translationally for prestressing the spring element 82 or the setting piston 88 is held in a position counter to a spring force which is provided by the prestressed spring element 82, in order, as a result, to hold the prestress of the spring element 82, in particular in order to keep it at least substantially constant, which prestress is set by way of the position of the setting piston 88.

If, for example, a reduction in the volume of the setting chamber 92 and an increase in the volume of the setting chamber 86 occur, hydraulic fluid which is initially received in the setting chamber 94 can flow out of the setting chamber 92, for example via a line 104, and can flow, in particular, into the reservoir 24. Here, hydraulic fluid is conveyed into the setting chamber 86 out of the drive chamber 16 by means of the drive piston 18, or the abovementioned pressure which acts on the setting piston 88 and by means of which the setting piston is moved or is held in said position is maintained in the setting chamber 86 by means of the hydraulic fluid which is received therein, for as long as the piezo actuator 12 is actuated or activated, that is to say is triggered.

In some embodiments, two throttles 100 and 102 are arranged in the setting line 96. Hydraulic fluid can be conveyed out of the drive chamber 16 into the setting chamber 86 by means of the piezo actuator 12, in particular via the throttle 100. The throttles 100 and 102 have a respective flow cross section, through which the hydraulic fluid can flow, the flow cross section of the throttle 102 being smaller than the flow cross section of the throttle 100. As a result of the possibility of setting the opening pressure or the opening force of the check valve 80, the check valve is configured as a variable check valve. Here, the throttle 102 is arranged or connected fluidically in parallel with the setting chamber 86 or the setting piston 88.

If, for example, the actuation or triggering of the piezo actuator 12 is ended, the pressure in the setting chamber 86 drops and the setting piston 88 can no longer be held counter to the spring force in its position which is set and held by means of the pressure. The setting piston 88 is then displaced by means of the spring force in such a way that a reduction in the volume of the setting chamber 86 and an increase in the volume of the setting chamber 94 occur. Here, hydraulic fluid can flow via the line 104, in particular out of the reservoir 24, into the setting chamber 92, and hydraulic fluid can flow out of the setting chamber 86, in particular into the reservoir 24, for example via the throttle 102.

In the case of an increase of this type in the volume of the setting chamber 92 and a reduction in the volume of the setting chamber 86, the setting piston rod 94 is retracted into the setting chamber 92. As a result, for example, the spring element 82 is relieved, in particular is lengthened, as a result of which, for example, the opening force and therefore the opening pressure are reduced. Here, the respective setting chamber 86 or 92 acts as a hydraulic prestressing chamber, by means of which the prestress of the spring element 82 can be set. The higher, for example, the pressure in the setting chamber 86, the further the setting piston 88 is deflected and the more pronounced the extent to which the spring element 82 is stressed, and the higher the opening pressure or the opening force.

In some embodiments, a sixth check valve 98 is arranged in the setting line 96, which sixth check valve 98 is provided merely optionally, however, and can be dispensed with, and opens in the direction of the setting chamber 86 or 92 and closes in the direction of the drive chamber 16. As a result, hydraulic fluid can flow out of the drive chamber 16 via the setting line 96 and the check valve 98 into the setting chamber 86, an undesired flow of the hydraulic fluid out of the respective setting chamber 86 or 92 via the check valve 98 into the drive chamber 16 being prevented by means of the check valve 98.

In some embodiments, in relation to a flow of the hydraulic fluid from the drive chamber 16 to and into the setting chamber 86 and through the throttles 100 and 102, the throttle 100 is arranged fluidically in series with the setting chamber 86, the throttle 102 being arranged fluidically in series with the throttle 100 and fluidically in parallel with the setting chamber 86. This results in the following: in order to maintain the pressure in the setting chamber 86 and therefore the position of the setting piston 88 and therefore the prestress of the spring element 82, a quantity of the hydraulic fluid has to be conveyed by means of the piezo actuator 12 or by means of the drive piston 18, since, here, a first part of the quantity always flows into the setting chamber 86 and a second part of the quantity always flows through the throttle 102 and therefore does not flow into the setting chamber 86, and since, when the triggering of the piezo actuator 12 is ended, hydraulic fluid which is initially received in the setting chamber 86 can flow out of the setting chamber 86 via the throttle 102. Since the flow cross section of the throttle 102 is smaller than that of the throttle 100, the quantity which is conveyed by means of the piezo actuator 12 and the drive piston 16 flows through the throttle 100, and the second part of the quantity is smaller than the quantity itself, and the first part does not flow through the throttle 102, but rather into the setting chamber 86.

The variable check valve 80 therefore acts like a human muscle which relaxes when it is no longer supplied with energy. This also applies in the case of the check valve 80. If energy is no longer applied in order to maintain the pressure in the setting chamber 86 and to hold the setting piston 88 in its position, energy is no longer applied in order to keep the spring element 82 stressed, with the result that the spring element 82 is relieved.

In other words: as long as, for example, the PWM signal, by means of which the piezo actuator 12 is actuated, remains at least substantially constant, a pressure which is built up in the drive chamber 16 is dissipated via the throttle 100, with the result that hydraulic fluid flows from the drive 14 into the setting chamber 86. Here, the respective throttle 100 or 102 has a hydraulic resistance for the hydraulic fluid. Together with other parameters, the hydraulic resistance of the respective throttle 100 or 102 has an influence on a quantity of the hydraulic fluid which flows into the respective setting chamber 86 at a given time, and therefore on the opening pressure of the check valve 80.

As soon as the pressure of the hydraulic fluid exceeds the set opening pressure, hydraulic fluid flows from the outputs 32 and 44 or from the supply lines 60 and 62 via the discharge line 78 and the check valve 80 back into the reservoir 24. As a result, the piezohydraulic actuator 10 can behave like a soft actuator, in particular when the signal for actuating the piezo actuator 12 has a constant electric voltage only during a short time period, which constant electric voltage is converted into a relatively low opening pressure. Secondly, the piezohydraulic actuator 10 can act as a particularly rigid actuator, in particular when the opening pressure is high, which rigid actuator can move the output element even counter to a particularly high counterforce, or in the case of which rigid actuator a high counterforce has to be applied to the output element or to the output pistons 38 and 50, in order to move the output pistons 38 and 50 in such a way that a reduction in the volume of the output chambers 34 and 46 occurs.

If, for example, a reduction in the volume of the setting chamber 86 and an increase in the volume of the setting chamber 92 occur, the hydraulic fluid can, for example, be discharged out of the setting chamber 86 via the line 104, it being possible, for example, for the hydraulic fluid to flow via the discharge line 78 into the setting chamber 92.

In some embodiments, the reservoir 24 comprises a reservoir cylinder 106 and a reservoir piston 108 which is received in the reservoir cylinder 106 such that it can be moved translationally, the reservoir cylinder 106 and the reservoir piston 108 delimiting a reservoir chamber 110 of the reservoir 24 in each case partially. Here, the hydraulic fluid 22 is received in the reservoir chamber 110. If, for example, at least part of the hydraulic fluid 22 is discharged out of the reservoir chamber 110, a reduction in the volume of the reservoir chamber 110 occurs, as a result of which the reservoir piston 108 is moved translationally relative to the reservoir cylinder 106 by a travel or by a path $s_{res}$. If, for example, the hydraulic fluid is introduced into the reservoir chamber 110, an increase in the volume of the reservoir chamber 110 and a corresponding translational movement of the reservoir piston 108 relative to the reservoir cylinder 106 occur.

It can be seen overall, furthermore, that the piezo actuator 12 is actuated, for example, during a time period during which the PWM signal has an at least substantially constant electric voltage. Said time period is also called time duration, duration or duty cycle. Therefore, a small duty cycle, that is to say a brief duration, sets the piezohydraulic actuator 10 as a softly acting actuator, a high duty cycle, that is to say a long duration, allowing the piezohydraulic actuator to act as a rigid or hard actuator. In the case of the piezohydraulic actuator 10, there is therefore a dependence between the duty cycle and a variable impedance which is realized by way of the actuation of the piezo actuator 12 in combination with the function of the variable check valve 80 in the manner of a human muscle.

If hydraulic fluid is conveyed, that is to say is pumped, by means of the piezo actuator 12 and the drive piston 16 via the throttle 100 into the setting chamber 86, in order to prestress the spring element 82, part (the abovementioned second part of the quantity) of the conveyed hydraulic fluid flows out via the throttle 102 and does not flow into the setting chamber 86. When the triggering of the piezo actuator 12 is ended, all the hydraulic fluid which is received in the setting chamber 86 flows out via the throttle 102, that is to say out of the setting chamber 86. Therefore, in order to maintain the prestress of the spring element 82, the piezo actuator has to be constantly triggered and hydraulic fluid has to be pumped into the setting chamber 86. If, for example, no hydraulic fluid is received in the setting chamber 86, the spring element 82 is, for example, always soft or is not prestressed. By way of operating or triggering of the piezo actuator 12, the spring element 82 is initially prestressed. The throttle 100 has the function, in particular, that, in the case of triggering of the piezo actuator 12 and a flow which is brought about as a result of the hydraulic fluid which is fundamentally to flow via the check valve 76 to the drives 32 and 44, a small part of the flow of the hydraulic fluid flows via the throttle 100 into the setting chamber 86, in order to prestress the spring element 82 or to keep it prestressed.

The variable impedance of the actuator 10 is then realized, for example, by way of the variable prestress of the spring element 82, which prestress can be set as required. The abovementioned dependence between the duty cycle and the variable impedance then consists in the following, for example: if the duty cycle is brief, at least approximately all of said hydraulic fluid which is configured, for example, as oil is pumped via the check valve 76 to the drives 32 and 44. A long or longer duty cycle in comparison results in the following, however: after the check valve 76 has opened, a residual pressure which is brought about, in particular, by way of the drive piston 18 and by way of the long duty cycle prevails in the drive chamber 16, with the result that hydraulic fluid, in particular a greater quantity of hydraulic fluid than in the case of the brief duty cycle, flows into the setting chamber 86 via the throttle 100. As a result, for example, the spring element 82 is prestressed to a greater extent by means of a long duty cycle than by means of a duty cycle which is briefer in comparison.

In some embodiments, the piezohydraulic actuator 10 is an actuator unit, it being possible for the actuator unit to be set as required with regard to its speed-force operating point by way of setting of the frequency of the PWM signal which is also called an actuating signal, it being possible for the actuator unit to be set with regard to its impedance or flexibility by said duty cycle.

What is claimed is:

1. A piezohydraulic actuator comprising:

a piezo actuator;

a drive having a drive chamber supplied with a hydraulic fluid and a drive piston element delimiting the drive chamber and driven by the piezo actuator;

a first output having a first output chamber and a first output piston element;

wherein at least part of the hydraulic fluid is conveyed out of the drive chamber by movement of the drive piston element and into the first output chamber;

wherein the first output piston element delimits the first output and includes a hydraulically active first output face loaded with hydraulic fluid introduced into the first output chamber;

a second output having a second output chamber and a second output piston element;

wherein at least part of the hydraulic fluid is conveyed out of the drive chamber and into the second output chamber;

wherein the second output piston element delimits the second output chamber and a hydraulically active second output face which is larger or smaller than the first output face and can be loaded with hydraulic fluid introduced into the second output chamber and driven by loading the second output face with the hydraulic fluid introduced into the second output chamber; and a coupling device mechanically coupling the first output piston element to the second output piston element.

2. The piezohydraulic actuator as claimed in claim 1, further comprising:

a first supply line connecting the drive chamber to the first output chamber;

a second supply line connecting the first supply line to the second output chamber; and a first check valve arranged in the second supply line, wherein the first check valve opens in a direction of the second output chamber and closes in a direction of the first supply line.

3. The piezohydraulic actuator as claimed in claim 1, further comprising:

a third supply line connecting the drive chamber to a reservoir via which the hydraulic fluid can be introduced into the drive chamber; and a second check valve arranged in the third supply line, wherein the second check valve opens in a direction of the drive chamber and closes in a direction of the reservoir.

4. The piezohydraulic actuator as claimed in claim 2, further comprising:

a fourth supply line connecting the second output chamber to a reservoir via which hydraulic fluid can be introduced into the second output chamber, bypassing the first and second supply line; and a third check valve arranged in the fourth supply line, wherein the third check valve opens in a direction of the second output chamber and closes in a direction of the reservoir.

5. The piezohydraulic actuator as claimed in claim 2, wherein the second supply line connects to the first supply line at a connecting point; and further comprising a fourth check valve arranged in the first supply line upstream of the connecting point, wherein the fourth check valve opens in a direction of the connecting point and closes in a direction of the drive chamber.

6. The piezohydraulic actuator as claimed in claim 1, further comprising:

a discharge line connecting to at least one of the output chambers via which at least part of the hydraulic fluid can be discharged out of the at least one output chamber to a reservoir; and a fifth check valve arranged in the discharge line, wherein the fifth check valve opens in a direction of the reservoir and closes in a direction of the at least one output chamber.

7. The piezohydraulic actuator as claimed in claim 6, wherein the fifth check valve has an adjustable opening force.

8. The piezohydraulic actuator as claimed in claim 7, wherein the adjustable opening force of the fifth check valve is set by prestressing a spring element.

9. The piezohydraulic actuator as claimed in claim 8, further comprising a setting element assigned to the spring element;

wherein the setting element includes a setting chamber, receiving at least part of the hydraulic fluid conveyed out of the drive chamber, and a setting piston element delimiting the setting chamber and moved by the hydraulic fluid introduced into the setting chamber; and wherein the prestress of the spring element is set by a position of the setting piston element.

10. The piezohydraulic actuator as claimed in claim 9, further comprising a setting line connecting the setting chamber to the drive chamber and via which at least the part of the hydraulic fluid can be introduced into the setting chamber.

11. The piezohydraulic actuator as claimed in claim 10, further comprising a sixth check valve arranged in the setting line, wherein the sixth check valve opens in a direction of the setting chamber and closes in a direction of the drive chamber.

12. The piezohydraulic actuator as claimed in claim 10, further comprising a throttle arranged in the setting line and via which at least the part of the hydraulic fluid can be introduced into the setting chamber.

13. The piezohydraulic actuator as claimed in claim 12, further comprising a second throttle arranged in series with the first throttle and in parallel with the setting piston element, a first part of the flow flowing into the setting chamber and, in parallel, a second part of the flow flowing through the second throttle in the case of a flow (brought about by means of the piezo actuator and the drive piston element) of the hydraulic fluid out of the drive chamber through the setting line and the first throttle.

* * * * *